United States Patent [19]

Newell

[11] 4,093,185

[45] June 6, 1978

[54] DRIVE MECHANISM FOR A LINE-PULLING APPARATUS

[76] Inventor: E. Strohm Newell, 2350 6th Ave., San Diego, Calif. 92101

[21] Appl. No.: 700,154

[22] Filed: Jun. 28, 1976

[51] Int. Cl.[2] ..... B66D 1/30

[52] U.S. Cl. ..... 254/154; 74/505

[58] Field of Search ..... 254/150 R; 74/504, 505

[56] References Cited

U.S. PATENT DOCUMENTS

| | | | |
|---|---|---|---|
| 309,477 | 12/1884 | Luther | 254/150 R |
| 1,413,292 | 4/1922 | Rauscher | 254/150 R |
| 3,730,483 | 5/1973 | Newell | 254/150 R |
| 3,962,935 | 6/1976 | Hutton et al. | 254/150 R |
| 3,968,953 | 7/1976 | Guangorena | 254/150 R |

*Primary Examiner*—Drayton E. Hoffman

*Assistant Examiner*—Donald W. Underwood

*Attorney, Agent, or Firm*—Lowe, King, Price & Markva

[57] ABSTRACT

In a line pulling apparatus comprising a capstan and a pulley that rotate in unison on the stationary sleeve of a conventional capstan drive unit, line is wrapped around both the capstan and pulley for positive gripping of the line. A stationary plate member disposed between the capstan and pulley, contains a set of gears that extend above and below the plate member for stable, three-point engagement with teeth formed in the capstan and pulley. A line guide mechanism including a cut-out section on the plate member guides line from the capstan to the pulley. An upstanding member formed on the plate member holds the line in the pulley during rotation.

36 Claims, 3 Drawing Figures

DRIVE MECHANISM FOR A LINE-PULLING APPARATUS

BACKGROUND OF THE INVENTION

The present invention relates generally to a line pulling apparatus, and more particularly to a line pulling apparatus having a combination capstan and pulley for positive gripping of the line.

In the past, winches have been commonly used to pull line, e.g., a jib sheet winch is used on sailboats for pulling line taut through the use of a winch arm or crank. The winch typically comprises a capstan rotatably mounted on a stationary centerpost. The line is wrapped several times around the capstan and the rope is pulled taut. The capstan rotates as the rope is pulled manually or may be operated by motor to pull the rope.

In some situations, insufficient friction may be established between the capstan and line causing slippage. For example, occasionally the line must be pulled through a conduit. In order to reduce the friction between the line and conduit, the line may be coated with plastic, or lubricated. Obviously, there is substantial slippage between the line and capstan. In order to reduce slippage, I have disclosed, in my U.S. Pat. No. 3,730,483, a pulley secured to the capstan for rotation therewith. In a specific embodiment of that patent and by no means limited thereto, a stationary member is seated between the pulley and capstan. A bracket secured to the seated member extends around the outside of the pulley and is secured to a stationary centerpost. A stationary line disengagement member extends from the bracket into the annular groove of the pulley. The stationary disengagement member automatically disengages the line from the pulley during rotation.

SUMMARY OF THE INVENTION

The present invention is directed toward a unique system for coupling together the pulley and capstan for common rotation and for guiding and disengaging the line with respect to the pulley in a line pulling apparatus of the type described above.

As described herein, the apparatus combination comprises a capstan, a pulley means and a means for rotating the capstan and pulley means in unison about a centerpost. The rotating mechanism includes a bearing surface means and a coupling means. The coupling means dynamically interconnects the capstan and pulley means while moving juxtaposed a coupling bearing portion of said bearing surface means.

Briefly, in accordance with a specific embodiment of the invention, a stationary plate member is located between a pulley and capstan on the centerpost including a stationary sleeve of a conventional capstan drive unit. The plate member contains a set of three gears equispaced from each other and engaging teeth formed in lower and upper rims respectively of the pulley and capstan. The gears and rims form a planetary gear system having stable, three-point contact with respect to the capstan and pulley. Rotation of the capstan is coupled through the gears to the pulley so that the capstan and pulley rotate in unison.

In more detail, the upper end of the capstan contains a raised, annular rim, and teeth are formed on the inner surface of the rim. The lower end of the pulley also contains an annular rim, and there are also teeth formed on the inner surface of that rim.

The plate member contains a circular base, and an inner, concentric portion that is thicker than the base. The gears are rotatably mounted in apertures formed in the inner concentric portion. These gears engage the teeth of both the capstan and pulley when the capstan and pulley are assembled to the plate member.

The plate member is secured to the stationary sleeve. Rotation of the capstan is coupled to the pulley via the gears. Thus, the pulley and capstan rotate as a single unit with respect to the stationary plate member and sleeve.

A ring-shaped member is disposed within the annular groove of the pulley. A portion of the ring member extends outside the pulley and is engaged with an upstanding bracket secured to the plate member. Thus, the ring member is held stationary. The ring member effects disengagement of the line from the pulley. The line is guided from the capstan to the pulley through a cut-out portion in the base of the plate member. An upstanding member formed on the plate member adjacent the pulley holds the line in the pulley during rotation.

The pulley itself is comprised of upper and lower pulley sections. Each section contains a series of ribs and troughs disposed transversely to the circumference of the annular groove that is formed between the sections when they are assembled. The ribs and troughs enhance the gripping action on the line within the annular groove, and establish a positive, non-friction engagement between the pulley and line. Such a pulley is disclosed in my U.S. Pat. No. 3,343,809.

The upper section of the pulley contains a pair of pawl members extending inwardly with respect to the pulley to engage a ratchet formed on the main shaft. The pawl and ratchet permit rotation of the pulley in only one direction.

PURPOSE OF THE INVENTION

Accordingly, the primary object of the present invention is to provide a new and improved line-pulling apparatus.

Another object is to provide an apparatus for pulling a line wherein a pulley is mounted for common rotation with the capstan.

A still further object of the present invention is to provide a new and improved line-pulling apparatus including a pulley and capstan combination and a planetary gear system for coupling the combination together.

BRIEF DESCRIPTION OF THE DRAWINGS

Other objects of this invention will appear in the following description and referenced claims, reference being made to the accompanying drawings forming a part of the specification wherein like characters designate corresponding parts in the several views.

DESCRIPTION OF SPECIFIC EMBODIMENTS

Figure 1:
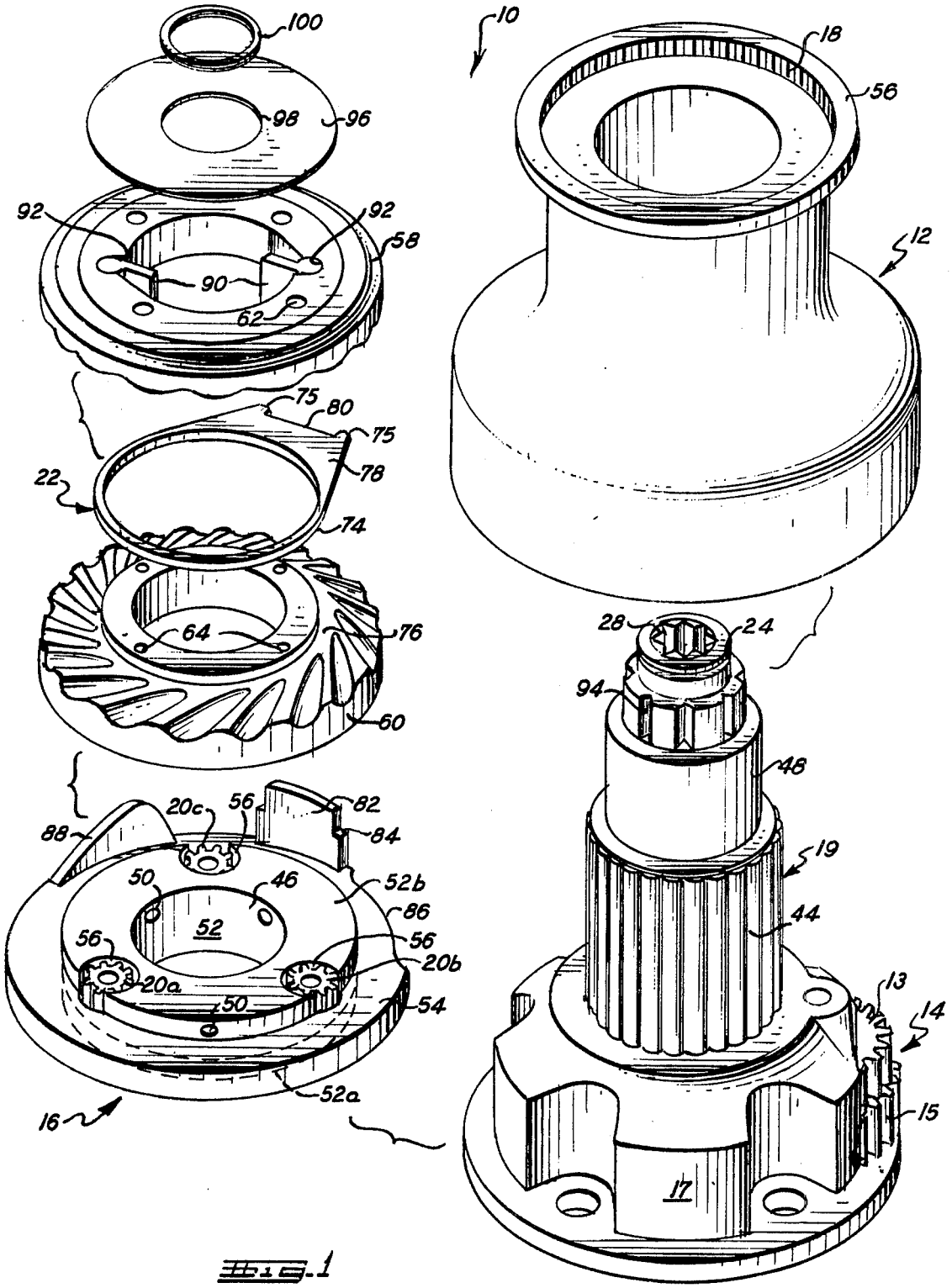
FIG. 1 is an exploded view of a line-pulling apparatus made in accordance with the invention.

More specifically, referring to the drawings, a line-pulling apparatus or winch, generally designated 10, comprises a capstan 12 rotatably mounted on a drive unit, generally designated 14. Capstan 12 and drive unit 14 constitute a conventional winch typically used on, e.g. sailboats, for pulling a line. This known structure includes gears 13 and 15 mounted on the base frame 17.

In accordance with the present invention, a stationary plate member 16 is fixedly mounted with respect to the centerpost 19 and seated within an annular rim 18 of capstan 12. Coupling means comprise gears 20*a*, 20*b* and 20*c* which dynamically interconnect capstan 12 to a pulley, generally designated 22. One end of gears 20*a*, 20*b* and 20*c* engage teeth formed on the inner surface of the rim 18, as shown.

Drive unit 14 comprises a centerpost 19 having a hollow drive shaft 24 rotatably mounted within a stationary post section 48. The inner surface 28 of shaft 24 is vertically grooved to receive a conventional winch arm as is known. Drive shaft 24 extends downwardly for engagement with drive gears 13 and 15 through spur gear 36. Drive gears 13 and 15 also engage teeth 38 formed on lower portion 42 of capstan 12.

Drive unit 14 is conventional and is not described in detail herein. However, in operation, the drive gears 13 and 15 cause rotation of capstan 12 around post 48 on pin roller bearings 44 in response to rotation of drive shaft 24. Drive gears 13 and 15 also reduce the speed of rotation of capstan 12 in favor of increased torque.

The mechanism of this invention is used for rotating the capstan 12 and pulley 22, in unison about the centerpost 19. Coupling means is mounted to dynamically interconnect the capstan 12 and the pulley 22 while moving juxtaposed a coupling bearing portion of bearing surface means. In this specific embodiment, the mechanism includes a disc-shaped plate member 16 having a center aperture 47 through which post portion 48 extends. Plate member 16 is fixedly secured with bolts (not shown) that are disposed within apertures 50 and tightened down against post portion 48. The bolts are recessed within the apertures 50 to avoid any interference with pulley 22.

Plate member 16 includes a circular base 54 and a concentric hub portion 52 that extends above and below the base. Lower section 52*a* of hub portion 52 sits within the rim 18 of capstan 12. The lower bearing surface of base 54 abuts the upper rim surface 56 of capstan 12. Thus, the capstan 12 is free to rotate about centerpost 19.

Gears 20*a*, 20*b* and 20*c* constitute coupling means and are rotatably mounted within apertures 56 formed in hub portion 52. The inside surfaces of apertures 56 constitute coupling bearing portion surfaces within which gears 20*a*, 20*b* and 20*c* are disposed and contained. Apertures 56 extend axially through and radially slightly beyond the periphery of the hub portion 22. Consequently, a portion of the gears 20*a*–20*c* is exposed as shown in FIG. 1. The lower exposed portion of each gear 20*a*, 20*b* and 20*c* is engaged with the teeth formed in capstan rim 18 when the plate member 16 is assembled to capstan 12. When capstan 12 is rotated, gears 20*a*–20*c* are also caused to rotate within apertures 56.

The three gears 20*a*–20*c* are equispaced around the hub portion 52, and thus, make stable, three-point contact with capstan 12 and pulley 22. The apertures 56 and gears 20*a*, 20*b* and 20*c* are thus separated from each other around centerpost 19 by an angle of 360°/N, where N is the number of gears. In this embodiment, N equals 3. The upper exposed portion of gears 20*a*, 20*b* and 20*c* engage pulley 22 as described below to simultaneously interact with capstan 12 and pulley 22 to effect their rotation in unison about centerpost 19.

Figure 3:
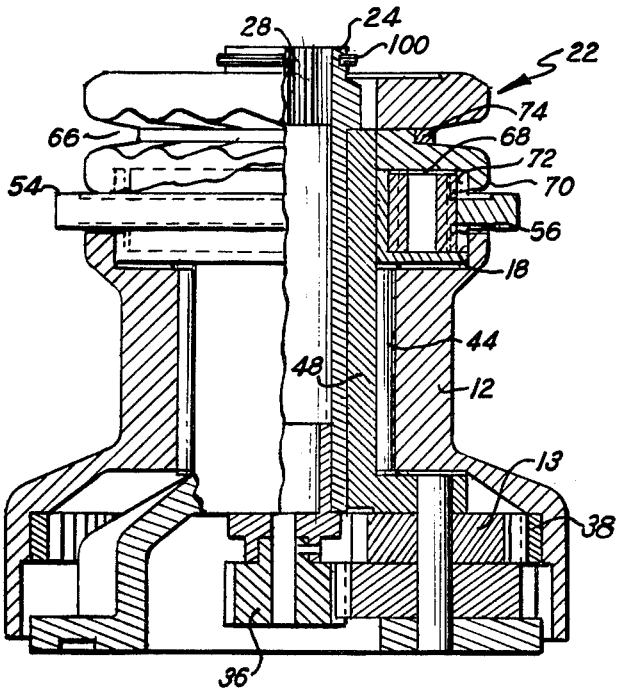
FIG. 3 is a cross-sectional side view of the apparatus taken along the line III—III in FIG. 2.

Pulley 22 comprises an upper pulley section 58 and a lower pulley section 60 bolted together through apertures 62 and 64, respectively, formed in the upper and lower sections. Pulley 22, when assembled, contains an annular, V-shaped groove 66 (FIG. 3). A plurality of rims and troughs is disposed transversely to the circumference of the annular grooves at regular intervals along the surface thereof in accordance with the disclosure of my U.S. Pat. No. 3,343,809. Although all types of pulleys may be used as pulley 22 in this invention, I have found that the specific use of the pulley member shown in my patent in combination with capstan 12 effects superior pulling results.

A center portion 68 (FIG. 3) of the lower surface of pulley member 60 is recessed to form annular rim 70. The inner surface 72 of rim 70 contains teeth that engage with gears 20*a*, 20*b* and 20*c* when lower pulley section 60 is mounted on hub portion 52. Thus, the upper section 52*b* of hub portion 52 forms a pedestal for seating pulley section 60. Thus, rotation of capstan 12 is coupled, via the gears 20*a*, 20*b* and 20*c* to pulley 22 and the capstan and pulley rotate together as a single unit.

A collar 74 (FIG. 1) is disposed between the upper and lower pulley sections 58 and 60, respectively. The upper surface of pulley section 60 contains annulus 76. Collar 74 is seated in annulus 76 when the upper and lower pulley members 58 and 60 are assembled. Pulley 22 is free to rotate with respect to collar 74.

Collar 74 contains an extended portion 78 having a cut-out 80 which engages upstanding bracket 82 secured to base 54. Upstanding bracket 82 includes shoulders 84 for receiving ears 75 of extended portion 78. Collar 74 is stationary and functions as a guide for line exiting annular groove 66. In addition, the ring-shaped portion of collar 74 funtions as a base within groove 66.

Base 54 includes a gate or cut-out portion 86 to guide and permit unobstructed movement of the line from the capstan 12 to the pulley 22. An upstanding member 88 is formed on base 54 and holds the line within the ribs and trough of the annular groove 66 as the pulley is rotated. Member 88 is curved inwardly toward pulley 22 so as to gently keep the line from falling out of the ribs and troughs as the line passes between the pulley 22 and member 88.

Figure 2:
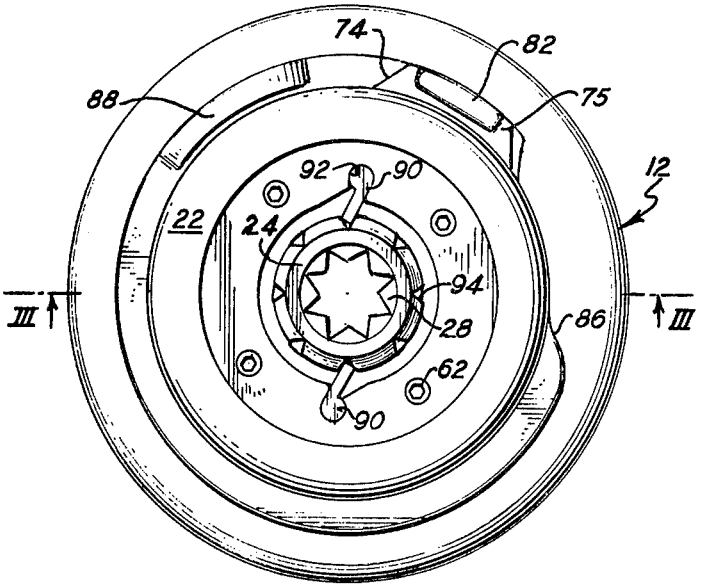
FIG. 2 is a top view of the apparatus shown in FIG. 1.

Upper pulley member 58 contains a pair of pawls 90 loosely mounted within seats 92. Pawls 90 engage ratchet teeth 94 formed on the main shaft post 48 of drive unit 14 (see also FIG. 2). Pawls 90 and ratchet teeth 94 permit rotation of the pulley 22 in only one direction. That is, when the drive shaft 24 is rotated clockwise, the pawls 90 engage the shaft teeth 94 to rotate the combined pulley 12 and capstan 12 on a one-to-one ratio. This action drives the winch top to the bottom through the gear drive mechanism. When the shaft 24 is turned in a counter-clockwise direction, pawls 90 do not engage the shaft teeth 94. Consequently, the winch is driven from the bottom drive mechanism at a reduced gear ratio. When the winch is stationary and holding a load, pawls 90 and the gear teeth in the lower gear drive keep the winch stationary.

Cover plate 96 is located on the upper surface of pulley section 58. Plate 96 has a center aperture 98 to expose drive shaft 24 for access by winch handle in a known manner. Cover 96 and pulley 22 are retained to unit 14 with spring clip 100.

In operation, line is first wrapped around capstan 12 and then threaded through cut-out 86 to pulley 22. There is frictional engagement between the line and capstan 12. In this embodiment, there is positive, non-frictional contact between the line and pulley 22. The tail end of the line may be maintained in the pulley 22 even under load, or may be wrapped around a cleat.

While the drive mechanism for a line-pulling apparatus has been shown and described in detail, it is obvious that this invention is not to be considered as limited to the specific form disclosed, and that changes in detail and construction can be made therein within the scope of the invention, without departing from the spirit thereof.

Having thus set forth and disclosed the nature of this invention, what is claimed is:

1. An apparatus for pulling a line comprising:
(a) a capstan mounted to rotate about stationary centerpost means,
(b) pulley means mounted to rotate about said centerpost means,
(c) means for rotating said capstan and pulley means in unison about said centerpost means, and
(d) stationary bearing surface means including a stationary coupling bearing portion fixedly mounted with respect to said centerpost means,
(e) said means for rotating including coupling means contained within the confines of said stationary coupling bearing portion and mounted to dynamically engage said capstan and pulley means while moving juxtaposed said coupling bearing portion.

2. An apparatus as defined in claim 1 wherein
said bearing surface means includes a plate member secured to said centerpost means and having said coupling bearing portion extending therethrough, and
said coupling means passes through said plate member and retained by said coupling bearing portion to engage said capstan and pulley means.

3. An apparatus as defined in claim 1 wherein
said bearing surface means includes a plate member secured to said centerpost means and having a plurality of apertures defined by bearing surfaces extending therethrough and constituting said coupling bearing portion, and
said coupling means includes gear means rotatably disposed within said apertures and passing through said plate member to engage said capstan and pulley means.

4. An apparatus as defined in claim 1 wherein
said bearing surface means includes a plate member secured to said centerpost means,
said plate member has said coupling bearing portion extending therethrough and a pulley means bearing surface,
said coupling means passes through said plate member and retained by said coupling bearing portion to engage said capstan and pulley means, and
said pulley means being rotatably mounted on said pulley means bearing surface.

5. An apparatus as defined in claim 1 wherein
said bearing surface means includes said coupling bearing portion and a pulley means bearing surface, and
said coupling means is contained by said coupling bearing portion and simultaneously interacts with said capstan and pulley means to effect said rotating in unison of the capstan and pulley means,
said pulley means being rotatably mounted on said pulley means bearing surface.

6. An apparatus as defined in claim 5 wherein
said bearing surface means includes a plate member secured to said centerpost means and having a plurality of apertures defined by bearing surfaces extending therethrough,
said apertures constituting said coupling bearing portion, and
said coupling means includes gear means rotatably disposed within said apertures and passing through said plate member to engage said capstan and pulley means.

7. An apparatus as defined in claim 5 wherein
said bearing surface means includes a plate member secured to said centerpost means,
said plate member has said coupling bearing portion extending therethrough and a pulley means bearing surface,
said coupling means passes through said plate member and retained by said coupling bearing portion to engage said capstan and pulley means, and
said pulley means being rotatably mounted on said pulley means bearing portion.

8. An apparatus as defined in claim 5 wherein
said coupling means includes a plurality of gears passing through said coupling bearing portion and engaging said capstan and pulley means.

9. An apparatus as defined in claim 8 wherein
said bearing surface means has stationary means which includes a plurality of apertures defined by bearing surfaces extending therethrough and constituting said coupling bearing portion, and
said coupling means includes a plurality of gears rotatably contained within said apertures and passing through said stationary means to engage said capstan and pulley means.

10. An apparatus as defined in claim 9 wherein
said apertures are separated from each other around the centerpost means by an angle of 360°/N, where N is the number of gears.

11. An apparatus as defined in claim 10 wherein N equals 3.

12. An apparatus as defined in claim 1 wherein
said bearing surface means includes stationary means fixedly mounted with respect to said centerpost means,
said stationary means includes said coupling bearing portion and a pulley means bearing surface,
said capstan includes an upper surface having an annular rim with a set of teeth being disposed along an inner surface of said rim,
a portion of said stationary means being seated within said annular rim,
said pulley means includes a lower surface having an annular rim with a set of teeth being disposed along an inner surface of said rim, and
said coupling means includes gear means rotatably contained by said coupling bearing portion and engaging said sets of teeth on said annular rim.

13. An apparatus as defined in claim 12 wherein
said stationary means includes a plate member secured to said centerpost means and having a plurality of apertures defined by bearing surfaces extending therethrough,
said apertures constituting said coupling bearing portion, and
said gear means disposed within said apertures and passing through said plate member to engage said capstan and pulley means.

14. An apparatus as defined in claim 12 wherein said stationary means includes a plate member secured to said centerpost means, said plate member has said coupling bearing portion extending therethrough and a pulley means bearing surface, said coupling means passes through said plate member and retained by said coupling bearing portion to engage said capstan and pulley means, and said pulley means being rotatably mounted on said pulley means bearing surface.

15. An apparatus as defined in claim 12 wherein said gear means includes a plurality of gears passing through and being retained by said stationary means and engaging said capstan and pulley means.

16. An apparatus as defined in claim 15 wherein said coupling bearing portion includes a plurality of apertures defined by bearing surfaces extending therethrough and constituting said coupling bearing portion, and said coupling means includes a plurality of gears rotatably contained within said apertures and passes through said stationary means to engage said capstan and pulley means.

17. An apparatus as defined in claim 16 wherein said apertures are separated from each other around the centerpost means by an angle of 360°/N, where N is the number of gears.

18. An apparatus as defined in claim 1 wherein said bearing surface means includes a holding surface portion for urging the line into the pulley means.

19. In a line pulling apparatus having a capstan and a pulley combination that rotate in unison with a means for directing the movement of line from the capstan to the pulley, the mechanism comprising:

(a) means for rotating said capstan and pulley means in unison about a stationary centerpost means, and (b) stationary bearing surface means including a stationary coupling bearing portion fixedly mounted with respect to the centerpost means, (c) said means for rotating including coupling means contained within the confines of said stationary coupling bearing portion and mounted to dynamically engage said capstan and pulley means while moving juxtaposed said coupling bearing portion.

20. The mechanism as defined in claim 19 wherein said coupling means is contained by said coupling bearing portion and simultaneously interacts with said capstan and pulley means to effect said rotating in unison of the capstan and pulley means.

21. The mechanism as defined in claim 19 wherein said bearing surface means includes said coupling bearing portion and a pulley means bearing surface, and said coupling means is contained by said coupling bearing portion and simultaneously interacts with said capstan and pulley means to effect said rotating in unison of the capstan and pulley means.

22. The mechanism as defined in claim 19 wherein said bearing surface means includes said coupling bearing portion and a pulley means bearing portion, said capstan includes an upper surface having an annular rim with a set of teeth being disposed along an inner surface of said rim, a portion of said bearing surface means being seated within said annular rim, said pulley means includes a lower surface having an annular rim with a set of teeth being disposed along an inner surface of said rim, and said coupling means includes gear means rotatably contained by said coupling bearing portion and engaging said sets of teeth on said annular rim.

23. An apparatus for pulling a line comprising:

(a) a capstan mounted to rotate about stationary centerpost means, (b) pulley means mounted to rotate about said centerpost means, (c) means for rotating said capstan and pulley means in unison about said centerpost means, and (d) bearing surface means including a coupling bearing portion fixedly mounted with respect to said centerpost means, (e) said means for rotating including coupling means mounted to dynamically interconnect said capstan and pulley means while moving juxtaposed said coupling bearing portion, (f) said bearing surface includes a plate member secured to said centerpost means and having a plurality of apertures defined by bearing surfaces extending therethrough and constituting said coupling bearing portion, and (g) said coupling means includes gear means rotatably disposed within said apertures and passing through said plate member to engage said capstan and pulley means.

24. An apparatus for pulling a line comprising:

(a) a capstan mounted to rotate about stationary centerpost means, (b) pulley means mounted to rotate about said centerpost means, (c) means for rotating said capstan and pulley means in unison about said centerpost means, and (d) bearing surface means including a coupling bearing portion fixedly mounted with respect to said centerpost means, (e) said means for rotating including coupling means mounted to dynamically interconnect said capstan and pulley means while moving juxtaposed said coupling bearing portion, (f) said bearing surface means includes said coupling bearing portion and a pulley means bearing surface, and (g) said coupling means is contained by said coupling bearing portion and simultaneously interacts with said capstan and pulley means to effect said rotating in unison of the capstan and pulley means, (h) said pulley means being rotatably mounted on said pulley means bearing surface, (i) said coupling means includes a plurality of gears passing through said coupling bearing portion and engaging said capstan and pulley means.

25. An apparatus as defined in claim 24 wherein said bearing surface means has stationary means which includes a plurality of apertures defined by bearing surfaces extending therethrough, and said apertures constituting said coupling bearing portion and said coupling means includes a plurality of gears rotatably contained within said apertures and passing through said stationary means to engage said capstan and pulley means.

26. An apparatus as defined in claim 25 wherein said apertures are separated from each other around the centerpost means by an angle of 360°/N, where N is the number of gears.

27. An apparatus as defined in claim 26 wherein N equals 3.

28. An apparatus for pulling a line comprising:

(a) a capstan mounted to rotate about stationary centerpost means, (b) pulley means mounted to rotate about said centerpost means, (c) means for rotating said capstan and pulley means in unison about said centerpost means, and (d) bearing surface means including a coupling bearing portion fixedly mounted with respect to said centerpost means, (e) said means for rotating including coupling means mounted to dynamically interconnect said capstan and pulley means while moving juxtaposed said coupling bearing portion, (f) said bearing surface means includes stationary means fixedly mounted with respect to said centerpost means, (g) said stationary means includes said coupling bearing portion and a pulley means bearing surface, (h) said capstan includes an upper surface having an annular rim with a set of teeth being disposed along an inner surface of said rim, (i) a portion of said stationary means being seated within said annular rim, (j) said pulley means includes a lower surface having an annular rim with a set of teeth being disposed along an inner surface of said rim, and (k) said coupling means includes gear means rotatably contained by said coupling bearing portion and engaging said sets of teeth on said annular rim, (l) said gear means includes a plurality of gears passing through said stationary means and retained by said coupling bearing portion, (m) said gears engaging said capstan and pulley means, (n) said coupling bearing portion includes a plurality of apertures defined by bearing surfaces extending therethrough and constituting said coupling bearing portion, and (o) said gears being rotatably contained within said apertures and passing through said stationary means to engage said capstan and pulley means.

29. An apparatus as defined in claim 28 wherein said apertures are separated from each other around the centerpost means by an angle of 360°/N, where N is the number of gears.

30. An apparatus for pulling a line comprising:

(a) a capstan mounted to rotate about stationary centerpost means, (b) pulley means mounted to rotate about said centerpost means, (c) means for rotating said capstan and pulley means in unison about said centerpost means, and (d) bearing surface means including a coupling bearing portion fixedly mounted with respect to said centerpost means, (e) said means for rotating including coupling means mounted to dynamically interconnect said capstan and pulley means while moving juxtaposed said coupling bearing portion, (f) said bearing surface means includes a plate member secured to said centerpost means and having said coupling bearing portion extending therethrough, and (g) said coupling means passes through said plate member and retained by said coupling bearing portion to engage said capstan and pulley means.

31. An apparatus for pulling a line comprising:

(a) a capstan mounted to rotate about stationary centerpost means, (b) pulley means mounted to rotate about said centerpost means, (c) means for rotating said capstan and pulley means in unison about said centerpost means, and (d) bearing surface means including a coupling bearing portion fixedly mounted with respect to said centerpost means, (e) said means for rotating including coupling means mounted to dynamically interconnect said capstan and pulley means while moving juxtaposed said coupling bearing portion, (f) said bearing surface means includes a plate member secured to said centerpost means, (g) said plate member has said coupling bearing portion extending therethrough and a pulley means bearing surface, (h) said coupling means passes through said plate member and retained by said coupling bearing portion to engage said capstan and pulley means, and said pulley means being rotatably mounted on said pulley means bearing surface.

32. An apparatus for pulling a line comprising:

(a) a capstan mounted to rotate about stationary centerpost means, (b) pulley means mounted to rotate about said centerpost means, (c) means for rotating said capstan and pulley means in unison about said centerpost means, and (d) bearing surface means including a coupling bearing portion fixedly mounted with respect to said centerpost means, (e) said means for rotating including coupling means mounted to dynamically interconnect said capstan and pulley means while moving juxtaposed said coupling bearing portion, (f) said bearing surface means includes said coupling bearing portion and a pulley means bearing surface, and (g) said coupling means is contained by said coupling bearing portion and simultaneously interacts with said capstan and pulley means to effect said rotating in unison of the capstan and pulley means, (h) said pulley means being rotatably mounted on said pulley means bearing surface, (i) said bearing surface means includes a plate member secured to said centerpost means and having a plurality of apertures defined by bearing surfaces extending therethrough, (j) said apertures constituting said coupling bearing portion, and (k) said coupling means includes gear means rotatably disposed within said apertures and passing through said plate member to engage said capstan and pulley means.

33. An apparatus for pulling a line comprising:

(a) a capstan mounted to rotate about stationary centerpost means, (b) pulley means mounted to rotate about said centerpost means, (c) means for rotating said capstan and pulley means in unison about said centerpost means, and
(d) bearing surface means including a coupling bearing portion fixedly mounted with respect to said centerpost means,
(e) said means for rotating including coupling means mounted to dynamically interconnect said capstan and pulley means while moving juxtaposed said coupling bearing portion,
(f) said bearing surface means includes said coupling bearing portion and a pulley means bearing surface, and
(g) said coupling means is contained by said coupling bearing portion and simultaneously interacts with said capstan and pulley means to effect said rotating in unison of the capstan and pulley means,
(h) said pulley means being rotatably mounted on said pulley means bearing surface,
(i) said bearing surface means includes a plate member secured to said centerpost means,
(j) said plate member has said coupling bearing portion extending therethrough and a pulley means bearing surface,
(k) said coupling means passes through said plate member and retained by said coupling bearing portion to engage said capstan and pulley means, and
(l) said pulley means being rotatably mounted on said pulley means bearing portion.

34. An apparatus for pulling a line comprising:
(a) a capstan mounted to rotate about stationary centerpost means,
(b) pulley means mounted to rotate about said centerpost means,
(c) means for rotating said capstan and pulley means in unison about said centerpost means, and
(d) bearing surface means including a coupling bearing portion fixedly mounted with respect to said centerpost means,
(e) said means for rotating including coupling means mounted to dynamically interconnect said capstan and pulley means while moving juxtaposed said coupling bearing portion,
(f) said bearing surface means includes stationary means fixedly mounted with respect to said centerpost means,
(g) said stationary means includes said coupling bearing portion and a pulley means bearing surface,
(h) said capstan includes an upper surface having an annular rim with a set of teeth being disposed along an inner surface of said rim,
(i) a portion of said stationary means being seated within said annular rim,
(j) said pulley means includes a lower surface having an annular rim with a set of teeth being disposed along an inner surface of said rim, and
(k) said coupling means includes gear means rotatably contained by said coupling bearing portion and engaging said sets of teeth on said annular rim,
(l) said stationary means includes a plate member secured to said centerpost means and having a plurality of apertures defined by bearing surfaces extending therethrough,
(m) said apertures constituting said coupling bearing portion, and
(n) said gear means disposed within said apertures and passing through said plate member to engage said capstan and pulley means.

35. An apparatus for pulling a line comprising:
(a) a capstan mounted to rotate about stationary centerpost means,
(b) pulley means mounted to rotate about said centerpost means,
(c) means for rotating said capstan and pulley means in unison about said centerpost means, and
(d) bearing surface means including a coupling bearing portion fixedly mounted with respect to said centerpost means,
(e) said means for rotating including coupling means mounted to dynamically interconnect said capstan and pulley means while moving juxtaposed said coupling bearing portion,
(f) said bearing surface means includes stationary means fixedly mounted with respect to said centerpost means,
(g) said stationary means includes said coupling bearing portion and a pulley means bearing surface,
(h) said capstan includes an upper surface having an annular rim with a set of teeth being disposed along an inner surface of said rim,
(i) a portion of said stationary means being seated within said annular rim,
(j) said pulley means includes a lower surface having an annular rim with a set of teeth being disposed along an inner surface of said rim, and
(k) said coupling means includes gear means rotatably contained by said coupling bearing portion and engaging said sets of teeth on said annular rim,
(l) said stationary means includes a plate member secured to said centerpost means,
(m) said plate member has said coupling bearing portion extending therethrough and a pulley means bearing surface,
(n) said coupling means passes through said plate member and retained by said coupling bearing portion to engage said capstan and pulley means, and
(o) said pulley means being rotatably mounted on said pulley means bearing surface.

36. An apparatus for pulling a line comprising:
(a) a capstan mounted to rotate about stationary centerpost means,
(b) pulley means mounted to rotate about said centerpost means,
(c) means for rotating said capstan and pulley means in unison about said centerpost means, and
(d) bearing surface means including a coupling bearing portion fixedly mounted with respect to said centerpost means,
(e) said means for rotating including coupling means mounted to dynamically interconnect said capstan and pulley means while moving juxtaposed said coupling bearing portion,
(f) said bearing surface means includes stationary means fixedly mounted with respect to said centerpost means,
(g) said stationary means includes said coupling bearing portion and a pulley means bearing surface,
(h) said capstan includes an upper surface having an annular rim with a set of teeth being disposed along an inner surface of said rim,
(i) a portion of said stationary means being seated within said annular rim,
(j) said pulley means includes a lower surface having an annular rim with a set of teeth being disposed along an inner surface of said rim, and (k) said coupling means includes gear means rotatably contained by said coupling bearing portion and engaging said sets of teeth on said annular rim, (l) said gear means includes a plurality of gears passing through said stationary means and retained by said coupling bearing portion, and (m) said gears engaging said capstan and pulley means.

* * * * *